United States Patent [19]

Borio et al.

[11] 4,294,178

[45] Oct. 13, 1981

[54] TANGENTIAL FIRING SYSTEM

[75] Inventors: Richard W. Borio, Somers; Arun K. Mehta, Windsor Locks, both of Conn.

[73] Assignee: Combustion Engineering, Inc., Windsor, Conn.

[21] Appl. No.: 57,049

[22] Filed: Jul. 12, 1979

[51] Int. Cl.[3] ..... F23D 1/00

[52] U.S. Cl. ..... 110/347; 431/173; 110/265

[58] Field of Search ..... 110/347, 204, 232, 234, 110/243, 244, 251, 265; 122/15, 22, 235 B; 431/173

[56] References Cited

U.S. PATENT DOCUMENTS

| | | | |
|---|---|---|---|
| 2,808,011 | 10/1957 | Miller et al. | 110/347 |
| 2,867,182 | 1/1959 | Crites | 110/347 |
| 2,979,000 | 4/1961 | Sifrin et al. | 110/265 |
| 3,136,536 | 6/1964 | Heinmann | 110/347 |
| 3,356,075 | 12/1967 | Livingston | 110/347 |
| 3,597,141 | 8/1971 | Fracke | 431/173 |
| 3,688,747 | 9/1972 | Connell | 122/235 B |
| 3,865,054 | 2/1975 | Monroe, Jr. | 110/244 |
| 3,887,326 | 6/1975 | Tounley | 432/99 |
| 4,150,631 | 4/1979 | Frey et al. | 110/347 |
| 4,159,000 | 6/1979 | Iwasaki et al. | 110/244 |

*Primary Examiner*—Henry C. Yuen

*Attorney, Agent, or Firm*—Robert L. Olson

[57] ABSTRACT

A furnace in which fuel, such as pulverized coal, is burned, with the fuel and air being introduced into the furnace through tangential burners located in each of the four corners thereof and being directed tangentially to an imaginary circle in the center of the furnace. The invention will be described with pulverized coal, but is not limited to coal. Combustion gases from downstream of the furnace are recirculated back to the furnace, and are also introduced into the furnace from the four corners, in a tangential manner. The coal is introduced along with primary air to be directed at the smallest of a series of concentric imaginary circles; the recirculated gases are directed tangentially at a somewhat larger imaginary circle; and the secondary air is directed tangentially at a still larger imaginary circle.

2 Claims, 5 Drawing Figures

TANGENTIAL FIRING SYSTEM

BACKGROUND OF THE INVENTION

The design and operation of a pulverized coal fired boiler is more dependent upon the effect of mineral matter in the coal than any other single fuel property. The sizing of the boiler and its design are largely determined by the behavior of the coal mineral matter as it forms deposits on the heat transfer surfaces in the lower furnace. Operation of the boiler may be affectd by the thermal, physical and chemical properties of the deposits. Ash deposits on the heat transfer surfaces can inhibit the heat absorption rates and with some coals can also cause corrosion of the heat transfer surfaces.

Another very important consideration in pulverized coal firing of steam generators is the production of nitrogen oxides ($NO_x$). Regulatory standards limiting the extent of $NO_x$ production from steam generators are being increasingly stringent in order to protect our environment. A variety of techniques to control $NO_x$ via combustion modifications have been studied by researchers throughout the world and it is very likely that the design of future fuel firing systems for steam generators will be greatly affectd by the stringency of regulatory standards and the available control techniques.

The transformation of mineral matter and the formation of $NO_x$ during combustion of pulverized coal are very complex phenomena involving aero-dynamics, physical, chemical and thermal considerations. Mineral matter in coal varies in composition and properties depending on the type of coal and its geographical origin. Laboratory research reveals that iron compounds comprise some of the key constituents in coal mineral matter relative to their contribution to the phenomena of slag formation. Slag formation on furnace walls can occur because of selective deposition of low-melting ash constituents. These low-melting ash constituents melt within the furnace into spherical globules that, due to their low drag coefficient, do not follow gas streamliners, and are deposited on the furnace walls. In conventional tangential fired systems, due to the inherent aero-dymanics, a reducing or low-oxygen atmosphere can occur in localized zones adjacent to the water-wall tube surfaces. Furthermore, it is an established fact that iron compounds of the type found in ash deposits have a lower melting point in a reducing atmosphere. The conventional firing system can result in slagging by a combination of localized reducing atmosphere in the vicinity of lower furnace walls and the selective deposition of low-melting constituents because of their inability to follow gas streamliners.

The phenomenon of $NO_x$ formation in pulverized coal-fired furnaces is also quite complex. The extent of $NO_x$ formation depends on the type of coal, furnace firing rate, mixing conditions, heat transfer, and chemical kinetics. Two major forms of $NO_x$ have been recognized; thermal $NO_x$ and fuel $NO_x$. Thermal $NO_x$ results from the reaction of nitrogen in the air with oxygen and is highly temperature dependent. In a typical tangentially fired furnace using pulverized coal, the contribution of thermal $NO_x$ to the total $NO_x$ is less than about 20%, due to relatively low temperatures throughout the furnace. The present invention will not adversely affect this advantage with respect to thermal $NO_x$.

The major contributor of $NO_x$ is the fuel $NO_x$, which results from the reaction of fuel nitrogen species with oxygen. The fuel $NO_x$ formation is not very highly temperature dependent, but is a strong function of the fuel-air stoichiometry and residence time. A number of techniques to control fuel $NO_x$ have been developed to date, that involve modification of the combustion process. Some of the important ones involve low-excess-air firing and air staging.

A third form of $NO_x$, known as prompt $NO_x$, has also been recognized by researchers. Prompt $NO_x$ results from the combination of molecular nitrogen with hydrocarbon radicals in the reaction zone of fuel-rich flames. Formation of both the fuel $NO_x$ and prompt $NO_x$ involves intermediates such as CN, NH, and other complex species.

In pulverized coal firing, fuel nitrogen is evolved during both the devolatization and char burn-out stages. The degree of fuel nitrogen evolution during devolatization is a function of temperature and heating rate of coal particles. Further, the degree of conversion of evolved fuel nitrogen into $NO_x$ is highly dependent on the stoichiometry and residence time. Under fuel-rich conditions and with sufficient residence time available, the conversion of fuel nitrogen to harmless molecular nitrogen, rather than to $NO_x$, can be maximized.

In present-day tangentially fired systems, although the coal jet injected into the furnace of fuel-rich, the residence time available for conversion of volatile nitrogen to molecular nitrogen is extremely short before the jet contacts the oxygen-rich body of the tangential vortex. Further, the auxiliary air jets adjacent to the fuel-rich coal jet may interact with the nitrogen intermediates to yield $NO_x$ at the interface.

SUMMARY OF THE INVENTION

The furnace of a steam generator is fired so as to minimize both the formation of waterwall slagging and corrosion, and also the formation of nitrogen oxides. This is accomplished by tangentially firing the furnace with the fuel and primary air being introduced from the four corners and directed tangentially to an imaginary circle, the recirculated flue gas being directed tangentially to a surrounding or larger concentric circle, and the secondary air being directed tangentially to a still larger concentric circle.

DESCRIPTION OF THE PREFERRED EMBODIMENT

Figure 1:
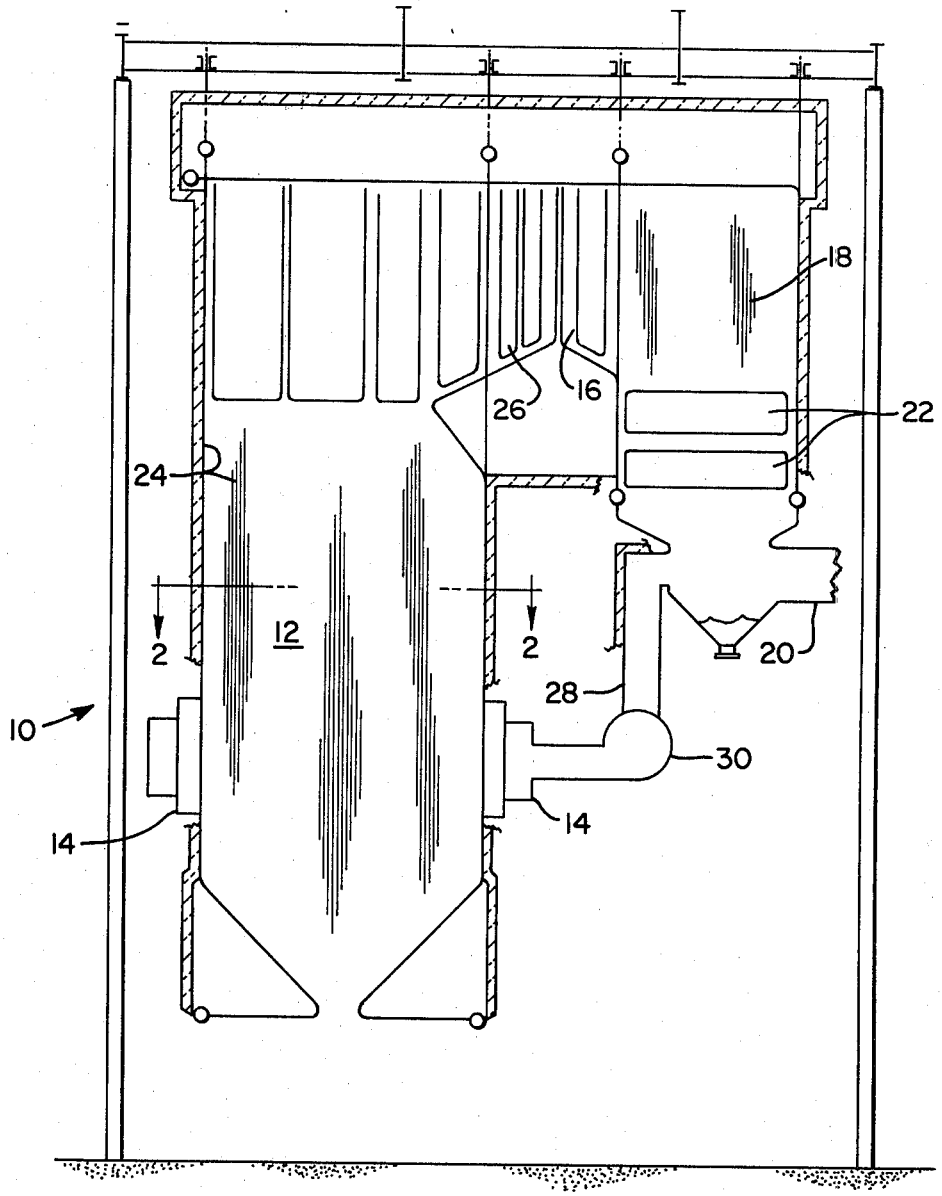
FIG. 1 is a diagrammatic representation of a coal-fired furnace in the nature of a vertical sectional view incorporating the present invention.

Looking now to FIG. 1 of the drawings, 10 designates a steam generating unit having a furnace 12. Fuel is introduced into the furnace and burned therein by tangential burners 14. The hot combustion gases rise and exit from the furnace through horizontal gas pass 16 and rear pass 18 before being exhausted to the atmosphere through duct 20 which is connected to a stack, not shown.

Steam is generated and heated by flowing through the various heat exchangers located in the unit. Water is heated in economizer 22 and the flows through he water tubes 24 lining the furnace walls, where steam is generated. From here the steam passes through the superheater section 26, and thereafter goes to a turbine, not shown.

In the illustrated unit, gases are recirculated back to the furnace through duct 28. A fan 30 is provided in the duct to provide for flow of gases when desired. The outlet ends of the gas recirculation duct 28 are positioned adjacent to the burners located in the four corners of the furnace, as will be explained in more detail with regard to FIGS. 2–5.

Figure 2:
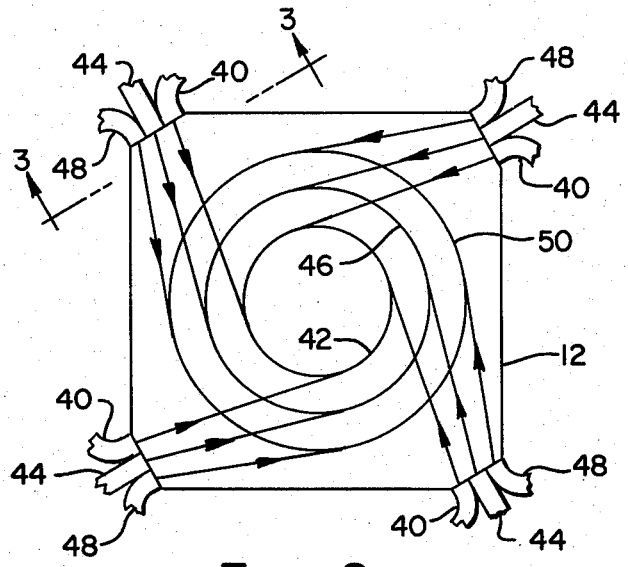
FIG. 2 is a sectional plan view of a furnace incorporating the invention taken on line 2—2 of FIG. 1.
Figure 3:
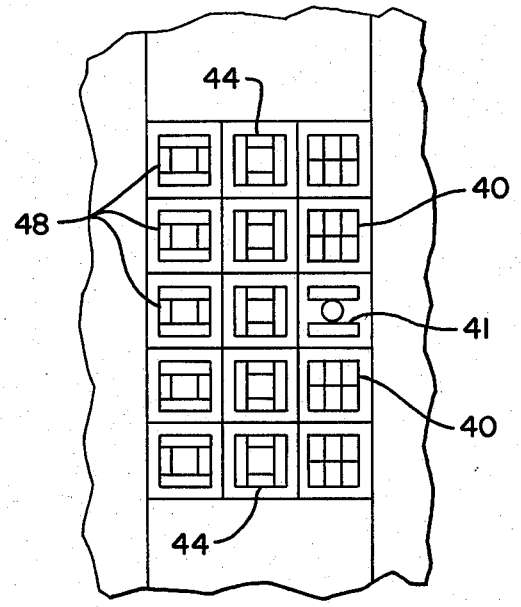
FIG. 3 is a partial view taken on line 3—3 of FIG. 2 showing one of the burner corners.

Looking now to FIGS. 2 and 3, it can be seen that the coal is introduced into the furnace 12 along with primary air, through nozzles 40. The coal and primary air streams are introduced tangentially, towards an imaginary circle 42, as seen in FIG. 2. The recirculated flue gases are introduced through nozzles 44 in such a manner that they flow toward an imaginary circle 46, which is concentric with and surrounds the circle the coal and primary air are directed at. The secondary or auxiliary air is introduced through nozzles 48 and is directed tangentially towards an imaginary circle 50 that is concentric with and surrounds the circle 46. Nozzle 41 shows an oil warm-up gun in keeping with conventional practice. FIG. 3 shows the arrangement of the nozzle outlets. All of these nozzle outlets are pivoted, so that they can be tilted upwardly or downwardly, and also from side to side.

The invention has a number of advantages from both slagging and $NO_x$ considerations. As can be seen, the primary air and coal stream is bounded by recirculated flue gas so that the initial reaction of fuel is restricted by the quantity of primary air supplied. This would delay complete reaction between the coal and air to a point further downstream in the furnace. The proposed concept can have a distinct advantage in minimizing slag formation on the lower furnace wall. The introduction of recirculated flue gas and auxiliary/secondary air outboard from the coal/primary air stream will increase the chances of carrying particulates out of the furnace, and the presence of a strongly oxidizing atmopshere adjacent to the furnace walls will increase the melting point of iron-containing compounds in the ash that may be present in deposits. The presence of an oxidizing air blanket adjacent to the furnace walls could also minimize corrosion in these coals where pyrosulphate attack normally occurs.

Further, this arrangement provides a very favorable setting for $NO_x$ reduction. The coal jets are injected into the inner zone of the tangential vortex at all of the fuel admission elevations, thus forming a long inner core of fuel-rich mixture that is separated from the auxiliary/secondary air blanket. The coal particles will devolatilize in a very short time, releassing the fuel nitrogen and allowing sufficient residence time for the $NO_x$ reduction to occur in the fuel-rich zone. As the devolatilized char particles move up along the furnace, they will tend to move centrifugally towards the outer air blanket thus promoting better fuel/air mixing downstream of the burner zone. The char burn-out thus will take place in a favorable oxygen-rich environment, resulting in improved kinetics of the combustion of the char. Mixing of the initially separated fuel-rich and oxygen-rich zones can be enhanced, if necessary, by injecting overfire air (not shown).

Figure 4:
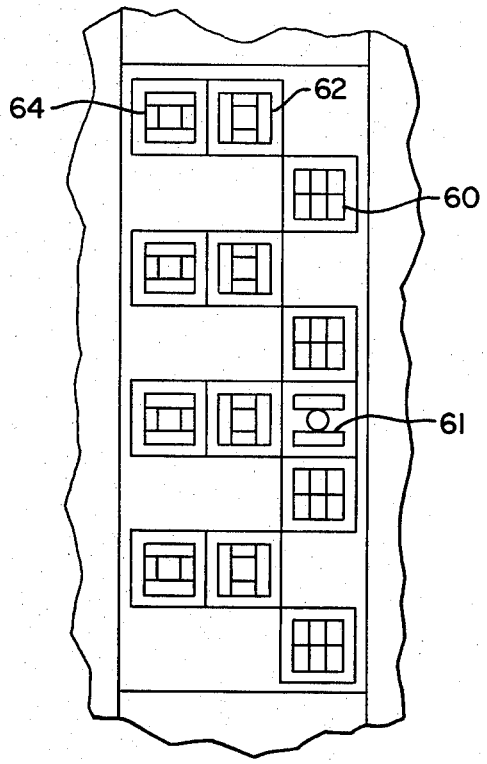
FIG. 4 is a partial view of an alternative embodiment, showing the arrangement of the various ports in a burner corner.

FIG. 4 shows an alternative arrangement that is based on the concept shown in FIG. 2 and is also conductive to the reduction of $NO_x$ and the formation of wall slag. In this arrangement, the primary air and coal nozzle 60 is inside of a gas recirculation nozzle 62, which in turn is inside of an auxiliary/secondary air nozzle 64; further nozzles 62 and 64 are at the same level and are one elevation above nozzle 60. These nozzles direct the fuel/primary air, recirculated gas, and auxiliary/secondary air tangentially of three concentric imaginary circles and are capable of horizontal and vertical tilting capabilities. Nozzle 61 shows an oil warm-up gun. Thus, this arrangement would tend to operate in nearly the same manner as the embodiment shown in FIG. 3. Some benefit in preventing wall slag and $NO_x$ formation would be gained in merely directing the secondary air at an imaginary circle somewhat spaced from and concentric with the imaginary circle the primary air/fuel is directed to without any intermediate layer of recirculated gas. The wall would be protected and the dead space between the two circles would prevent intermixing at least for a short while.

Figure 5:
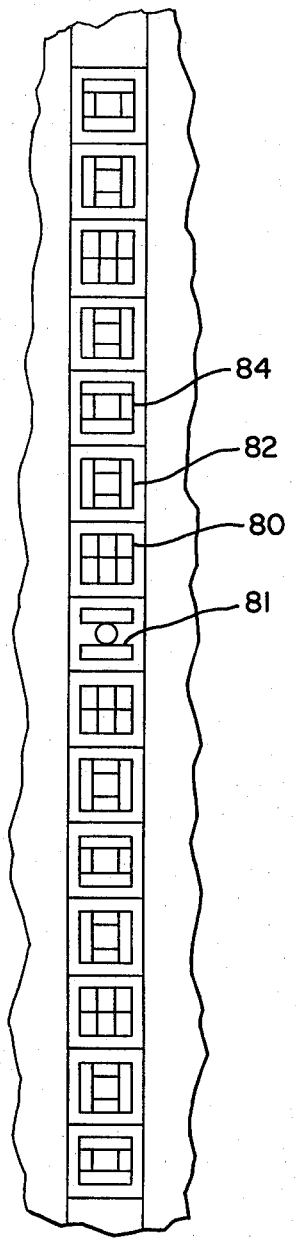
FIG. 5 is another partial view of a further alternative embodiment, showing the arrangement of the various ports in a burner corner.

FIG. 5 is yet another alternative arrangement that is also based on the concept shown in FIG. 2 and is also conducive to the reduction of $NO_x$ and wall slagging. In this arrangement, the primary air/fuel nozzle 80, the gas recirculation nozzle 82, and the auxiliary or secondary air nozzles 84 are shown in a vertical arrangement. Each coal/primary air nozzle 80 is separated from the auxiliary air nozzle 84 by a recirculation gas nozzle 82. These nozzles are provided with a horizontal tilting capability in addition to a vertical tilting capability such that the coal/primary air is directed tangentially to an inner imaginary circle; the recirculation gas is directed tangentially to a concentric and outer imaginary circle and the auxiliary air is directed to a concentric and outermost imaginary circle. Nozzle 81 is an oil warm-up gun. This arrangement most closely approximates current design practice.

From the above, it can be seen that a furnace arrangement has been provided which protects the furnace walls from slag deposits, and also greatly reduces the formation of $NO_x$ in a coal-fired furnace.

What is claimed is:

1. The method of operating a furnace having four walls, a first set and second set of nozzle means, with each set having nozzle means located in each of the four corners of the furnace, the method of operation comprising introducing pulverized coal and primary air into the furnace through the first set of nozzle means in such a manner that the streams of coal and primary air are directed tangentially to a first imaginary, substantially horizontal, circle in the center of the furnace, introducing secondary air into the furnace through the second set of nozzle means in such a manner that the stream of secondary air are directed tangentially to a second imaginary circle spaced from, concentric with, and surrounding the first imaginary circle, in order to reduce $NO_x$ in the exhaust gases, and also maintain an oxidizing atmosphere adjacent the furnace walls, thus reducing slagging and corrosion of the furnace walls.

2. The method set forth in claim 1, wherein the furnace has a third set of nozzle means, having nozzle mans located in each of the four corners of the furnace, with the additional step of introducing recirculated gases into the furnace through the third set of nozzle means in such a manner that the streams of recirculated gases are directed tangentially to a third imaginary circle concentric with and intermediate the first and second imaginary circles.

* * * * *

US004294178B1

REEXAMINATION CERTIFICATE (1709th)

United States Patent [19]

[11] B1 4,294,178

Borio et al.

[45] Certificate Issued Jun. 2, 1992

[54] TANGENTIAL FIRING SYSTEM

[75] Inventors: Richard W. Borio, Somers; Arun K. Mehta, Windsor Locks, both of Conn.

[73] Assignee: Combustion Engineering Inc., Windsor, Conn.

Reexamination Request:
No. 90/002,316, Apr. 11, 1991

Reexamination Certificate for:

| | |
|---|---|
| Patent No.: | 4,294,178 |
| Issued: | Oct. 13, 1981 |
| Appl. No.: | 57,049 |
| Filed: | Jul. 12, 1979 |

[51] Int. Cl.[5] ..... F23D 1/00
[52] U.S. Cl. ..... 110/347; 431/173; 110/265
[58] Field of Search ..... 122/15, 22, 23, 58; 110/265, 347, 244

[56] References Cited

U.S. PATENT DOCUMENTS 3,224,419 12/1965 Lowenstein et al. .

OTHER PUBLICATIONS

Friedrich, J. L. "Nitrogen Oxides Reduction" Proceedings of the $NO_x$ Control Technology Seminar, Feb. 1976.

*Primary Examiner*—Henry C. Yuen

[57] ABSTRACT

A furnace in which fuel, such as pulverized coal, is burned, with the fuel and air being introduced into the furnace through tangential burners located in each of the four corners thereof and being directed tangentially to an imaginary circle in the center of the furnace. The invention will be described with pulverized coal, but is not limited to coal. Combustion gases from downstream of the furnace are recirculated back to the furnace, and are also introduced into the furnace from the four corners, in a tangential manner. The coal is introduced along with primary air to be directed at the smallest of a series of concentric imaginary circles; the recirculated gases are directed tangentially at a somewhat larger imaginary circle; and the secondary air is directed tangentially at a still larger imaginary circle.

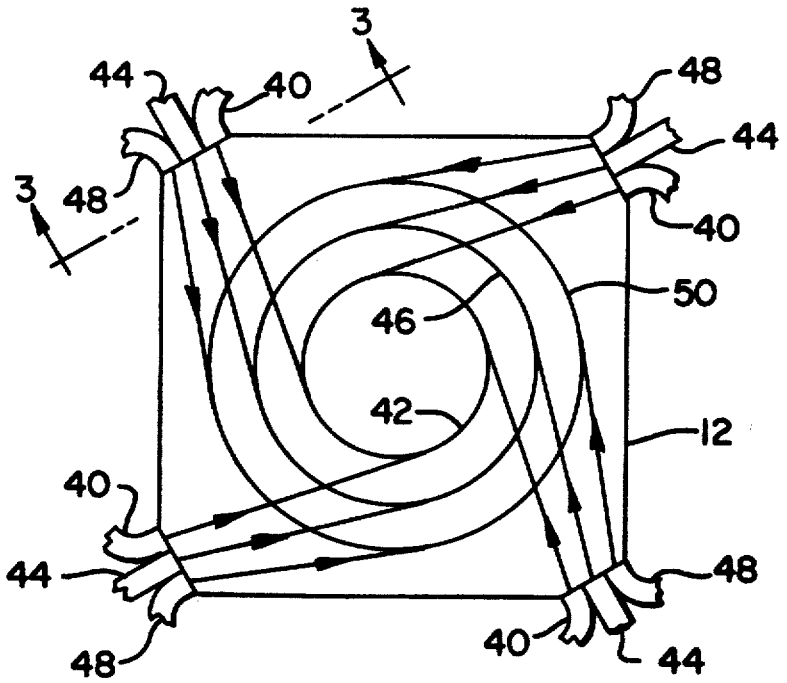

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 2 are determined to be patentable as amended.

1. The method of operating a furnace having four walls, *a single, vertically arranged burner assembly located in each of the four corners of the furnace, each of the single, vertically arranged burner assemblies* including a first set *of nozzle means* and *a* second set of nozzle means, [with each set having nozzle means located in each of the four corners of the furnace,] the method of operation comprising introducing pulverized coal and *the* primary air *in which the coal is entrained* into the furnace *from each of the single burner assemblies* through the first set of nozzle means *thereof* in such a manner that the streams of coal and primary air are directed tangentially to a first imaginary, substantially horizontal, circle in the center of the furnace, introducing *combustion supporting* secondary air into the furnace *from each of the single burner assemblies* through the second set of nozzle means *thereof* in such a manner that the streams of secondary air are directed tangentially to a second imaginary circle spaced from, concentric with, and surrounding the first imaginary circle, in order to reduce $NO_x$ in the exhaust gases, and also maintain an oxidizing atmosphere adjacent the furnace walls, thus reducing slagging and corrosion of the furnace walls.

2. The method [set forth in claim 1,] *of operating a furnace having four walls, a first set and second set of nozzle means, with each set having nozzle means located in each of the four corners of the furnace, the method of operation comprising introducing pulverized coal and primary air into the furnace through the first set of nozzle means in such a manner that the streams of coal and primary air are directed tangentially to a first imaginary, substantially horizontal, circle in the center of the furnace, introducing secondary air into the furnace through the second set of nozzle means in such a manner that the streams of secondary air are directed tangentially to a second imaginary circle spaced from, concentric with, and surrounding the first imaginary circle, in order to reduce $NO_x$ in the exhaust gases, and also maintain an oxidizing atmosphere adjacent the furnace walls, thus reducing slagging and corrosion of the furnace walls and* wherein the furnace has a third set of nozzle means, having nozzle means located in each of the four corners of the furnace, with the additional step of introducing recirculated gases into the furnace through the third set of nozzle means in such a manner that the streams of recirculated gases are directed tangentially to a third imaginary circle concentric with and intermediate the first and second imaginary circles.

* * * * *